US009487276B1

(12) United States Patent
Kusch

(10) Patent No.: US 9,487,276 B1
(45) Date of Patent: Nov. 8, 2016

(54) FIN SYSTEM FOR A BI-DIRECTIONAL WATERCRAFT

(71) Applicant: David Kusch, Greenwood, IN (US)

(72) Inventor: David Kusch, Greenwood, IN (US)

( * ) Notice: Subject to any disclaimer, the term of this patent is extended or adjusted under 35 U.S.C. 154(b) by 0 days.

(21) Appl. No.: 15/203,290

(22) Filed: Jul. 6, 2016

Related U.S. Application Data

(60) Provisional application No. 62/193,053, filed on Jul. 15, 2015.

(51) Int. Cl.
*B63B 35/79* (2006.01)
*B63B 39/06* (2006.01)

(52) U.S. Cl.
CPC ..... *B63B 35/7926* (2013.01); *B63B 35/79* (2013.01); *B63B 2039/065* (2013.01)

(58) Field of Classification Search
CPC . B63B 35/79; B63B 35/7926; B63B 35/793; B63B 35/7933; B63B 39/06; B63B 39/061; B63B 39/062; B63B 2039/065; B63B 41/00
USPC ..... 441/74, 79; 114/127–140, 143, 152
See application file for complete search history.

(56) References Cited

U.S. PATENT DOCUMENTS 7,740,512 B1 * 6/2010 Patterson ..... B63H 16/04 441/74
9,139,265 B2 * 9/2015 Peberdy ..... B63B 35/793

* cited by examiner

*Primary Examiner* — Ajay Vasudeva
(74) *Attorney, Agent, or Firm* — Roberts IP Law; John Roberts

(57) ABSTRACT

Disclosed is a bi-directional watercraft, such as a surfboard, fin systems therefore, and method of use. Example fin systems may allow a user of the watercraft to perform bi-directional maneuvers and stunts. The watercraft may be bi-directionally symmetric or asymmetric with fins mounted on its undersurface on both ends. When underway, the fins at the operating rear of the watercraft deploy for stabilization in cross-currents, while the fins at the operating front remain pivoted out of the way so that they do not "catch" water and destabilize the watercraft. When the watercraft reverses in direction, and the front and rear ends swap with one another, biasing mechanisms cause the fins now at the front to pivot away and hydrodynamic forces cause the fins now at the rear to deploy. In some cases, holders keep the fins from inadvertently deploying when they are not needed.

18 Claims, 7 Drawing Sheets

FIN SYSTEM FOR A BI-DIRECTIONAL WATERCRAFT

CROSS-REFERENCE TO RELATED APPLICATIONS

The present application claims priority to U.S. Provisional Patent Application Ser. No. 62/193,053, filed on Jul. 15, 2015 (herein "the '053 Application"), which is incorporated herein by reference in its entirety.

FEDERALLY SPONSORED RESEARCH OR DEVELOPMENT

None.

TECHNICAL FIELD

The present disclosure is related generally to sporting equipment and, more particularly, to personal watercraft.

BACKGROUND

Wave surfing is one of the oldest board sports. From the inspiration of surfing came "sidewalk surfing" or skate boarding, as well as snowboarding, wake boarding, and kite boarding. However, in spite of the longevity of surfing, the newer board sports have surpassed surfing in the complexity and variety of maneuvers and stunts performed by their riders. This is largely due to a surfboard being uni-directional (able to move forward for extended periods of time), while other board sports have equipment that allows them to move bi-directionally (able to move forward or backward for extended periods of time). The shape of modern skateboards, snowboards, wake boards, and kite boards have since adopted symmetrical designs (from front to back) which allows a wide variety of maneuvers.

The key challenge in designing a bi-directional surfboard is the fins (or skegs) of the surfboard. The fins are used to give lateral traction of the board as it slides down a wave. But if a surfer spins the board around 180 degrees, the fins (now at the front of the board) dig into the water, making the board unstable and preventing the surfer from riding with the fins in the front of the board for extended periods of time.

Other inventors have recognized this challenge, and there have been several attempts to create a bi-directional surfboard, but none of the attempts have been adopted by the surfing community. Attempts at a bi-directional surfboard include a board with ridges instead of fins, fins that retract into the surfboard, as well as reduced size of the fins. These ideas have not been adopted by the surf community for a number of reasons, including a decrease (perceived or real) in board performance, and a necessity of substantially altering how a surfer would use the surfboard. Thus, there remains a need for an invention that allows surfers to surf bi-directionally in a high performance manner without substantially changing the dynamics of wave riding.

SUMMARY

The present invention(s) elegantly overcome many of the drawbacks of prior systems and provide numerous additional improvements and benefits as will be apparent to persons of skill in the art. Provided in various example embodiments is a bi-directional watercraft, such as a surfboard, comprising a fin system configured to allow a user of the watercraft to perform bi-directional maneuvers and stunts. One example embodiment is shown in FIG. 1, where the watercraft is a surfboard that is bi-directionally symmetric with fins mounted on the undersurface of the board on both ends. When under way, the fins at the operating rear of the board (fins B in the Figure) deploy to stabilize the board in cross-currents, while the fins at the operating front of the board (fins A) pivot out of the way so that they do not "catch" water and destabilize the board. When the surfer directs the board in the opposite direction (not shown but easily imagined), and the front and rear ends swap with one another, spring forces cause the fins now at the front of the board to pivot away and hydrodynamic forces cause the fins now at the rear of the board to deploy. In various example embodiments, dynamic (spring) and static (mechanical) holders keep the fins from inadvertently deploying when they are not needed. The fin assemblies may be compact and lightweight to keep the overall weight of the board to a minimum, thus facilitating aerial maneuvers. The fin assemblies may also be configured to be strong enough to be effective even on large waves. The designs in various example embodiments may not require surfers to change their surfing style in order to benefit from the invention, as the fins may use hydrodynamic pressure to automatically deploy and spring forces to stow as needed.

For example, provided in various example embodiments is a watercraft comprising: a body extending longitudinally from a first end to a second end, the body comprising an undersurface; fin assemblies proximate the first end and the second end, each fin assembly comprising a fin pivotably coupled with the undersurface, wherein each fin is pivotable between a deployed position wherein the fin extends substantially perpendicularly to the undersurface, and a stowed position wherein each fin extends substantially parallel to the undersurface; wherein each fin assembly is configured so that when water flows past each fin in a chordwise direction from an end of the body distal that fin toward an end of the body proximate that fin, hydrodynamic force biases that fin toward the deployed position; and wherein each fin assembly comprises a biasing mechanism biasing each fin toward the stowed position so that each fin tends to return to the stowed position when no water flows past each fin.

In various example embodiments the watercraft may be any of a surfboard, a paddleboard, a kayak, or a wakesurf board, for example.

In various example embodiments the watercraft may further comprise two fin assemblies proximate the first end of the body and two fin assemblies proximate the second end of the body, the fin assemblies mounted to the body symmetrically (or asymmetrically) about a longitudinal centerline of the body; wherein the fins on a first side of the longitudinal centerline pivot in a first direction, and the fins on a second side of the longitudinal centerline pivot in a second direction opposite the first direction.

In various example embodiments one or more of the fin assemblies may comprise a stowed-position holder configured to tend to hold that fin assembly's fin in the stowed position and then to release the fin to pivot toward the deployed position when water flows past the fin with a sufficient force in a chordwise direction from an end of the body distal the fin toward an end of the body proximate the fin. In various example embodiments one or more of the fin assemblies may comprise a deployed-position holder configured to tend to hold that fin assembly's fin in the deployed position as long as water flows past the fin with a sufficient force in a chordwise direction from an end of the body distal the fin toward an end of the body proximate the fin.

Also provided in various example embodiments is a fin assembly comprising: a fin base comprising a watercraft mount configured to mount the fin assembly to a substantially planar surface of an exterior of a watercraft; a fin comprising a body extending in a first longitudinal direction from a front portion to a rear portion and extending in a second longitudinal direction from a base portion to a tip portion; a coupling configured to pivotably attach the base portion of the fin to the fin base so that when the fin assembly is mounted to the substantially planar surface of the exterior of the watercraft, the fin body may pivot about an axis that is at least substantially parallel with the first longitudinal direction to allow the fin body to pivot between a deployed position wherein the second longitudinal direction is substantially perpendicular to the planar surface of the exterior of the watercraft, and a stowed position wherein the second longitudinal direction is substantially parallel to the planar surface of the exterior of the watercraft; and a biasing element configured to bias the fin toward the stowed position.

In various example embodiments the coupling may comprise a hinge or an elastomeric element, for example. In various example embodiments a fin assembly may further comprise a stowed-position holder configured to tend to hold the fin in the stowed position, the stowed-position holder comprising a mechanical interference between the fin and the fin base when the fin is in the stowed position. In various example embodiments a fin assembly may further comprise a deployed-position holder configured to tend to hold the fin in the deployed position. In various example embodiments a deployed-position holder may comprise a slot in the coupling that engages the fin when the fin is in the deployed position. In various example embodiments a fin assembly may further comprise a stowed-position holder configured to tend to hold the fin in the stowed position, the stowed-position holder comprising an interference element configured to tend to prevent the fin from pivoting toward the deployed position when the fin is in the stowed position. In various example embodiments an interference element may comprise a lever rotatable between at least two positions. In various example embodiments a fin may be configured to be longitudinally translated from a first longitudinal position to a second longitudinal position, and the interference element comprises a portion of the fin that mechanically interferes with another portion of the fin assembly when the fin is in the first longitudinal position and does not mechanically interfere with said another portion of the fin assembly when the fin is in the second longitudinal position. In various example embodiments a fin may be configured to be longitudinally translated from the first longitudinal position to the second longitudinal position by the force of water traveling over the fin.

Further provided in various example embodiments is a method of incorporating a fin assembly with a substantially planar surface of an exterior of a watercraft, the method comprising the steps of: providing a fin assembly comprising: a fin base comprising a watercraft mount configured to mount the fin assembly to a substantially planar surface of an exterior of a watercraft; a fin comprising a body extending in a first longitudinal direction from a front portion to a rear portion and extending in a second longitudinal direction from a base portion to a tip portion; a coupling configured to pivotably attach the base portion of the fin to the fin base so that when the fin assembly is mounted to the substantially planar surface of the exterior of the watercraft, the fin body may pivot about an axis that is at least substantially parallel with the first longitudinal direction to allow the fin body to pivot between a deployed position wherein the second longitudinal direction is substantially perpendicular to the planar surface of the exterior of the watercraft, and a stowed position wherein the second longitudinal direction is substantially parallel to the planar surface of the exterior of the watercraft; and a biasing element configured to bias the fin toward the stowed position; and mounting the fin assembly to the substantially planar surface of the exterior of the watercraft.

In various example embodiments the method may further comprise the steps of: providing two of said fin assemblies; and mounting the fin assemblies to the substantially planar surface of the exterior of the watercraft symmetrically about a longitudinal centerline of the watercraft so that the fin on a first side of the longitudinal centerline pivots in a first direction, and the fin on a second side of the longitudinal centerline pivots in a second direction opposite the first direction. In various example embodiments the method may further comprise the steps of: providing a plurality of said fin assemblies; mounting at least a first two of the fin assemblies to the substantially planar surface of the exterior of the watercraft symmetrically about a longitudinal centerline of the watercraft and proximate a first end of the watercraft; mounting at least a second two of the fin assemblies to the substantially planar surface of the exterior of the watercraft symmetrically about a longitudinal centerline of the watercraft and proximate a second end of the watercraft opposite the first end of the watercraft; and said mounting steps positioning the fin assemblies so that the fins on a first side of the longitudinal centerline pivot in a first direction, and the fins on a second side of the longitudinal centerline pivot in a second direction opposite the first direction. In various example embodiments the method may further comprise the steps of: mounting the first two and the second two of the fin assemblies to the substantially planar surface of the exterior of the watercraft symmetrically about a line perpendicular to the centerline of the watercraft, so that: water flowing over the fins in a first direction parallel to the centerline of the watercraft urges the fins of the first two of the fin assemblies to pivot toward the deployed position; and water flowing over the fins in a second direction parallel to the centerline of the watercraft and opposite the first direction urges the fins of the second two of the fin assemblies to pivot toward the deployed position. In various example embodiments the method may further comprise the steps of: riding the watercraft so that water flows over the fins in the first direction and causing one or more the fins of the first two fin assemblies to pivot to the deployed position; riding the watercraft so that water stops flowing over the fins of the first two fin assemblies and causing the fins of the first two fin assemblies to pivot to the stowed position; and riding the watercraft so that water flows over the fins of the second two fin assemblies in the second direction and causing one or more the fins of the second two fin assemblies to pivot to the deployed position.

Additional aspects, alternatives and variations as would be apparent to persons of skill in the art are also disclosed herein and are specifically contemplated as included as part of the invention, including but not limited to all the embodiments shown or discussed in the '053 Application. The invention is set forth only in the claims as allowed by the patent office in this or related applications, and the summary descriptions of certain examples are not in any way to limit, define or otherwise establish the scope of legal protection.

BRIEF DESCRIPTION OF THE DRAWINGS

Various embodiments are depicted in the accompanying drawings for illustrative purposes, and should in no way be interpreted as limiting the scope of the embodiments. Furthermore, various features of different disclosed embodiments can be combined to form additional embodiments, which are part of this disclosure. It will be understood that certain components and details may not appear in the Figure(s) to assist in more clearly describing the invention.

FIG. 2(2) shows a fin with an example hydrofoil cross section. When flowing water (E) hits the leading edge of the fin, the hydrofoil creates a pressure differential leading to "lift" in direction (F).

In FIG. 4(1), the fin (G) is locked in the stowed position. The spring (K in FIG. 3) pushes the fin (G) forward, and physical interference (O, P) keeps the fin (G) from pivoting. In FIG. 4(2), water pressure (Q) pushes the fin (G) backward against the force of the spring (K in FIG. 3). This disengages (R) the stowed-position holder (H1, H2 of FIG. 3), allowing the fin (G) to respond to hydrodynamic pressure and to pivot (S) toward the deployed position. In FIG. 4(3), the fin (G) is fully deployed and is prevented from over-extending by pressure against the surface (T in FIG. 4(2)).

In FIG. 6(1), the rotating lever (V1) holds the fin (U) in the stowed position. In FIG. 6(2), flowing water (FF) pushes on the lever (V1) causes it to rotate (GG) back and disengage the stowed-position holder (V2 in FIG. 5). This frees the fin (U) to pivot to the deployed position as shown in FIG. 6(3).

DETAILED DESCRIPTION OF EXAMPLE EMBODIMENTS

Reference is made herein to some specific examples of the present invention, including any best modes contemplated by the inventor for carrying out the invention. Examples of these specific embodiments are illustrated in the accompanying Figure(s). While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all in certain embodiments. Accordingly, some implementations of the methods discussed herein may include more or fewer steps than those shown or described. Further, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

Turning to the drawings, wherein like reference letters refer to like elements, various example embodiments are illustrated as implemented in an example environment. Note that for the sake of clarity in the discussion, rather than repeatedly stating "watercraft" and "watercraft user," most of the examples refer to an example watercraft, namely a "surfboard," and the user a "surfer." These example references should not be interpreted to narrow the scope of the claims in any way.

Figure 1:
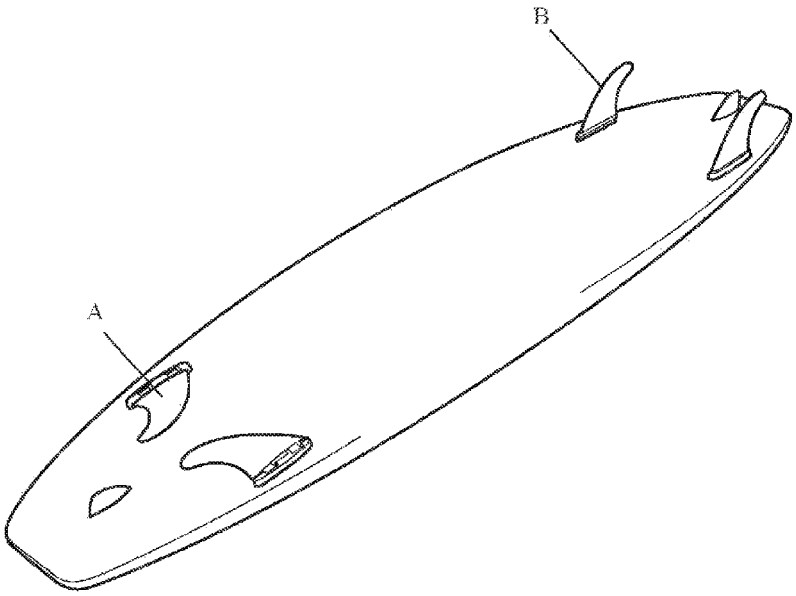
FIG. 1 shows an example surfboard that is symmetrical about its longitudinal axis and also about an axis perpendicular to and bisecting its longitudinal axis, with example fins at both ends. The fins on the end of the surfboard which is currently at the front are folded flat or "stowed" (A), while the fins at the back of the board are shown in the "deployed" position (B).

The Summary includes a detailed discussion of FIG. 1 which is not repeated here. In sum, the symmetric placement of the fins on both ends of the undersurface of the surfboard allows bi-directional surfing as long as the fins at the active front of the board (A in FIG. 1) are stowed away and are not operative. The present embodiments, discussed below, ensure that hydrodynamic forces (without the intervention of the surfer) deploy the fins (B in FIG. 1) at the active rear of the board to stabilize the craft while the fins (A) at the current front remain stowed to prevent them from destabilizing the craft. In various example embodiments not shown, either different numbers of fins may be placed at the front and rear of the surfboard, or different numbers of fins may be placed on either side of the longitudinal axis of the surfboard, or both, thus producing an asymmetrical arrangement. Also, the body of the surfboard or other structure might not be symmetrical regardless of fin placement.

Note that FIG. 1 also shows a small, static fin on the longitudinal centerline of the board at each end of the board. While some surfers prefer having one or more of these static fins in some situations, they are not always required. Additionally, some surfers may prefer more than two deployable fins at one or both ends of the board. For example surfers may prefer four deployable fins at one or both ends of the board. Any suitable number of fins may be used at either or both ends of the board.

Figure 2:
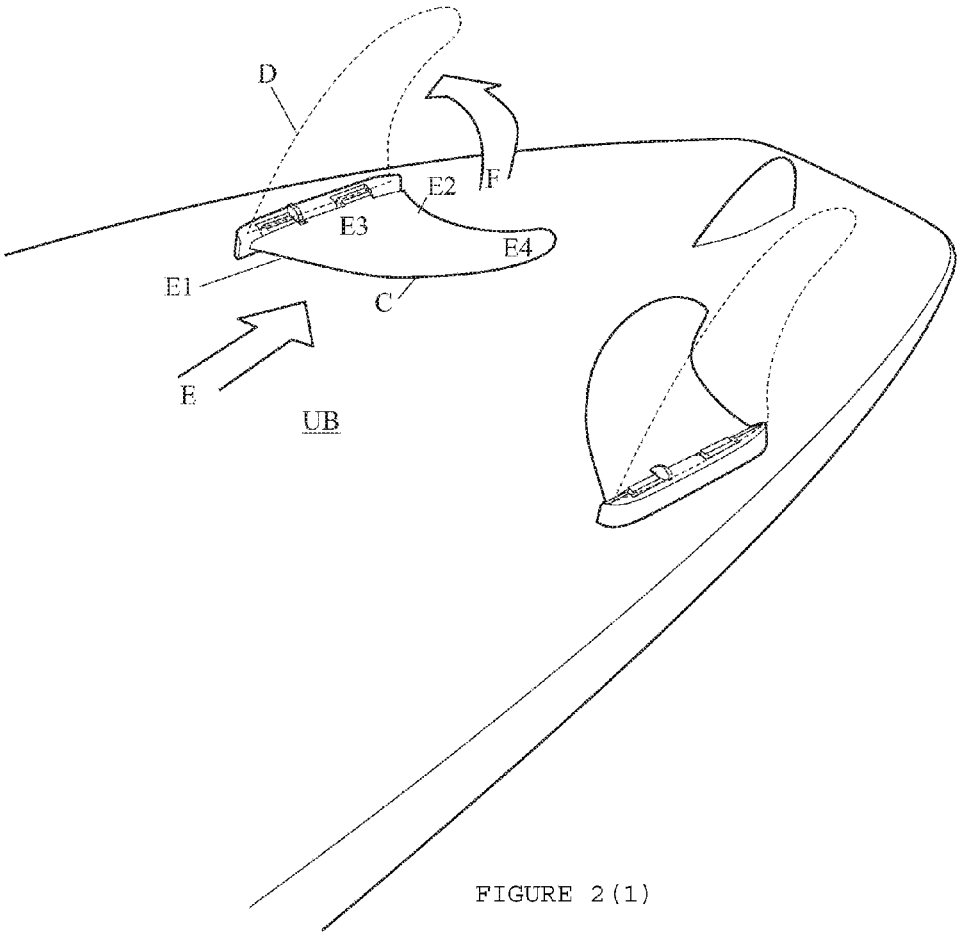
FIG. 2(1) shows an example fin in the stowed position (C). When flowing water (E) hits the leading edge of the stowed fin (C), the water (E) applies hydrodynamic pressure on the fin causing it to pivot (F) into the deployed position (D).
Figure 2:
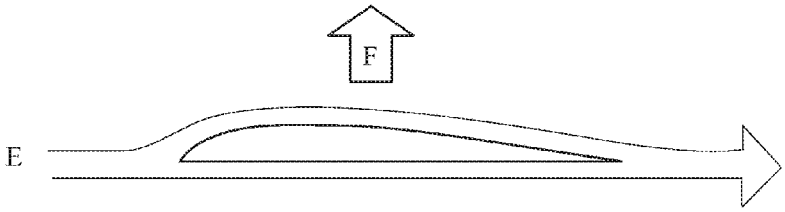

Turning to FIG. 2(1), example fins are shown comprising a body extending in a first longitudinal direction (E) from a front portion (E1) to a rear portion (E2) and extending in a second longitudinal direction from a base portion (E3) to a tip portion (E4). When the fins are at the operative front of the surfboard, they are put into a stowed position (C) that places the broad surface of the fin substantially parallel to the undersurface (UB) of the board. While in this stowed position (C), the fin has minimal effect on the behavior of the surfboard through the water. In some embodiments, for instance as discussed below, there may be one or more springs that bias the fin toward the stowed position (C).

When the surfer changes the direction of the board, what was the operative front end of the board becomes the operative rear. Water begins to flow (E) from the end of the board farther from the pictured fins (the "distal" end) toward the end near the fins (the "proximate" end). The fin assemblies are shaped or positioned (or both) so that water flowing in this direction (E), that is, water hitting the leading edge of the fin, exerts hydrodynamic pressure on the fin causing it to pivot (F) toward the deployed position (D) where the fin is substantially perpendicular to the undersurface of the board. While in this deployed position (D), the fin may function like a traditional fin fixed to the rear undersurface of the surfboard, especially with respect to transmitting force against the water in the direction toward the longitudinal centerline of the board. In some cases when water is moving across the fins at a net oblique angle (for instance when surfing across and slightly down the face of a wave while water is moving up the face of the wave), one fin at the rear of the board may fully deploy and provide stability to the board like a traditional fixed fin while the other fin at the rear of the board may move to a stowed or other not fully-deployed position. Thus, where the stability of at least two fixed fins is desired, a user may elect to have four pivotable fins at one or both ends of the board.

In FIG. 2(1), the axis of the pivots in the fin assembles are drawn roughly parallel to the longitudinal centerline of the surfboard. However, in some embodiments, the fins are installed at a slight (e.g., 0.5 to 5 degree) angle from the longitudinal centerline. In the arrangement of FIG. 2(1), the bases of the fins at their leading edges would typically be "toed in" and thus a little bit closer to each other than the bases at the trailing edges. When the fin is described as "substantially perpendicular" to the undersurface of the board, for purposes of this patent this means substantially perpendicular in the same way that fixed fins are typically attached to a board, i.e., with cant angles varying from zero (perfectly perpendicular) to plus or minus 15 degrees. Any suitable toe angles and cant angles may be employed as desired, for instance as known in sport of surfing. When the fin is described as "substantially parallel" to the undersurface of the board, for purposes of this patent this means sufficiently parallel that the fin does not materially affect the handling of the board in the water. It is understood that the undersurface (UB) of the board may be curved as is typical in the construction of the exteriors of watercraft, and the body of the fin will likely be curved as well. Thus, references to angles between these surfaces are intended to be approximate and measured accordingly.

An example method of using hydrodynamic force to deploy the fins is illustrated in FIG. 2(2). Here, the fins have a hydrofoil cross section so that when flowing water (E) hits the leading edge of the fin, the hydrofoil creates a pressure differential that "lifts" the fin in direction (F). The fin is mounted so that its hydrofoil upper surface (technically called the "suction surface") is away from the undersurface when the fin is in the stowed position (C). Thus, the hydrofoil lift tends to cause the fin to pivot out into the deployed position (D).

Some example embodiments (for instance as discussion below) may also use the pressure of the flowing water (E) to move the fin slightly toward the rear of the board to activate a mechanism that allows the fin to deploy. Because water only flows in this direction (E) when the fins should be deployed, it is safe to use this rearward shift of the fin to release the stowed-position holder thus allowing the fin to pivot toward the deployed position (D).

As the fin pivots to the deployed position (D), it is important that it not pivot too far. Different embodiments (for instance as discussed below) can use different mechanisms to prevent the fin from "over-extending" beyond the desired deployment angle. The deployment angle need not be exactly 90 degrees from the stowed angle. Some variation, commonly called cant angle, may be preferable and may be adjustable by the surfer or by the manufacturer of the fin assemblies.

Once the fin moves to the deployed position (D), some embodiments may use the water flow (E) to hold the fin in that deployed position (D), preventing it from pivoting back to the stowed position. Examples of such "deployed-position holders" are discussed below.

Finally, when the board turns around, the fins that were deployed (D) at the rear of the board are now at the front of the board and need to be returned to the stowed position (C). Any time a surfer does a maneuver to flip the board around, the fins that were on the operational end will for a moment (or several moments) be removed from the water. When the fins are removed from the water, the spring force or other biasing mechanism urges the fins toward the stowed position. Once the fins are in the stowed position, a stowed-position holder mechanism may activate to keep the fins in the stowed position. This feature is useful when the surfboard is taken out of the water because it keeps the fragile fins stowed and out of harm's way.

Figure 3:
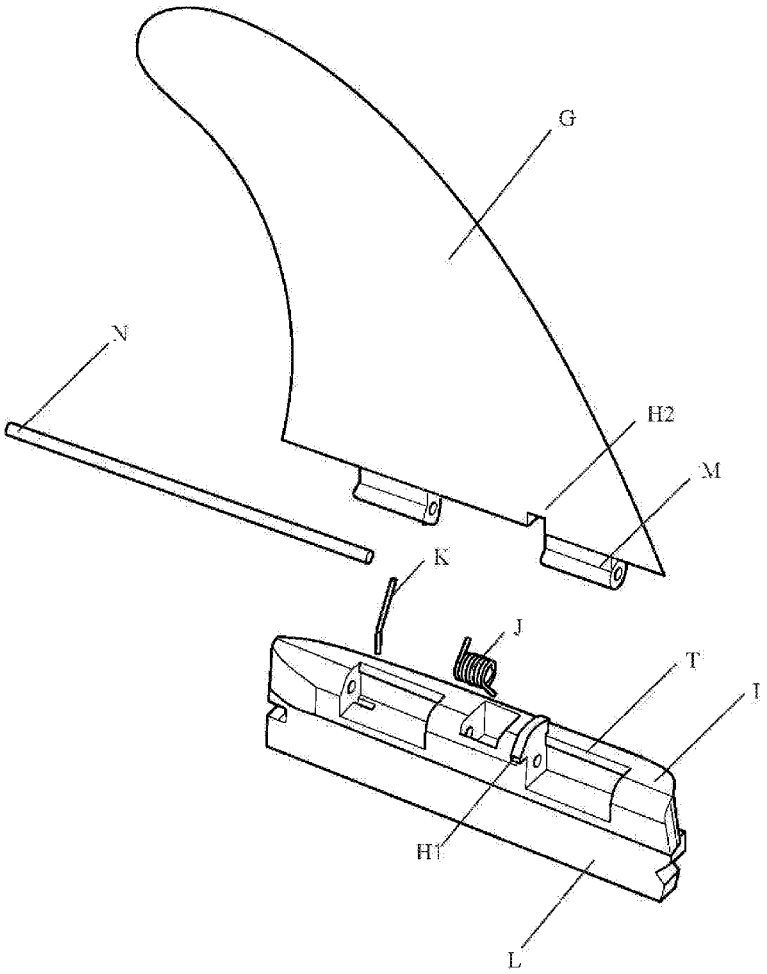
FIG. 3 shows an example embodiment of a fin assembly in which the mechanism may be positioned outside of the body of the watercraft. This allows the fin assembly to be attached to the watercraft by means of an existing fin-mounting system (such as Futures(TM) or FCS(TM)). In the particular embodiment of FIG. 3, the fin (G) pivots (hinges M and axle N) in the fin base (I) which attaches to the watercraft (not shown) via an existing fin-mounting system (L). Springs (J, K) work with a stowed-position holder (H1, H2) to keep the fin (G) in the stowed position until needed.
Figure 4:
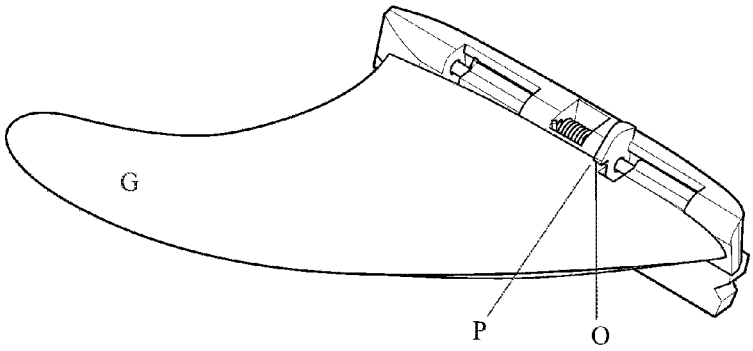
FIG. 4 shows the example fin (G) of FIG. 3 deploying.
Figure 4:
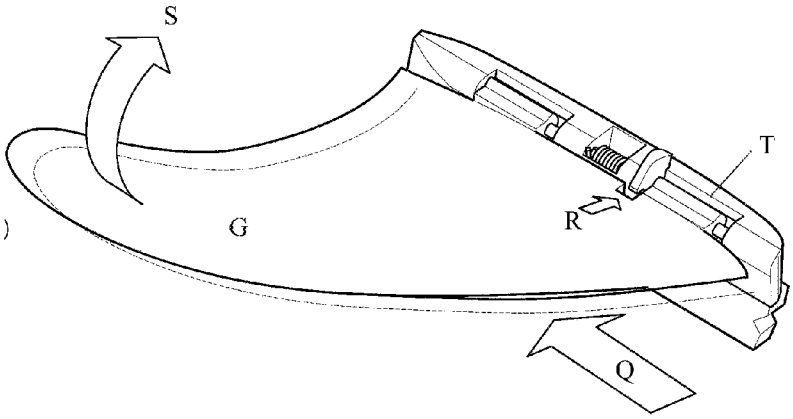
Figure 4:
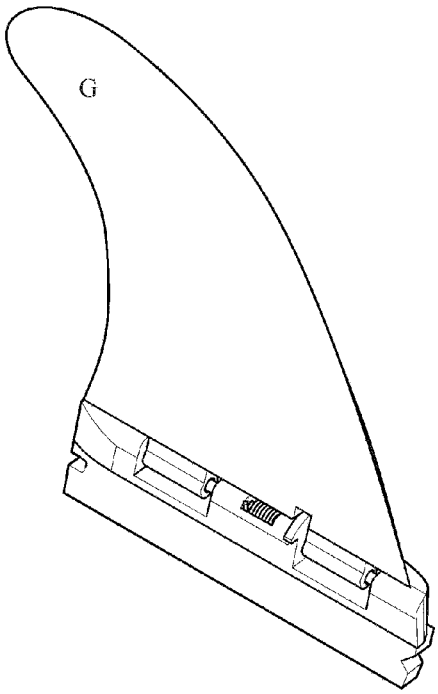

For a first example embodiment of a pivoting fin structure, FIGS. 3 and 4 may be considered together. FIG. 3 shows the working details of this embodiment, while FIG. 4 displays its operation. In FIG. 3, the fin (G) pivots on a fin base (I) using an axle (N) that fits through holes in the base of the fin (M). This pivoting arrangement can be replaced by, for example, an elastomeric edge at the base of the fin (G). For convenience sake, the fin base (I) is designed to fit into existing fin-attachment systems such as Futures(TM) or FCS(TM). Other fin-base mounting techniques are well known and can be used. A coil spring (J) (or some other biasing element) biases the fin (G) toward the stowed position.

The embodiment of FIGS. 3 and 4 includes a stowed-position holder. In addition to being able to pivot (N, M), the fin (G) can slide back and forth along the axle (N) in the fin base (I). (This direction of movement along the path from the leading edge of the fin (G) to the trailing edge or back is called "chordwise" or longitudinally translating movement.) A spring (K) biases the fin (G) to move forward as far as it can. The result is that when the fin (G) is in the stowed position (see FIG. 4(1)) and biased forward by spring (K), a protrusion (H1) of the fin base (I) interferes (O, P of FIG. 4(1)) with the fin (G) and prevents the fin (G) from pivoting toward the deployed position.

Now turning to FIG. 4(2), when the board turns around, and the stowed fin (G) is now at the rear, the water flows (Q) from the distal end to the proximate end of the board. The pressure of this flow (Q) creates drag on the fin (G) moving it against the force of the spring (K), and the fin (G) slides rearward along the axle (N). This disengages the stowed-position holder as follows: When the fin (G) is in the rearward position, a notch (H2 in FIG. 3) lines up (R of FIG. 4(2)) with the formerly interfering protrusion (H1) of the fin base (I). Thus, that protrusion (H1) no longer prevents the fin (G) from pivoting outwards (S in FIG. 4(2)). Note however that the spring (J) is still biasing the fin (G) toward the stowed position. The force of this spring (J) is overcome by hydrodynamic pressure exerted on the fin (G) by the water flow (Q), as discussed above with reference to FIG. 2. In the deployed position of FIG. 4(3), the fin (G) is prevented from over-extending when the outward pivoting fin (G) hits the shoulder (T) on the fin base (I) (see FIG. 3).

When the surfboard turns around again (or enters still water, or is taken out of the water completely), the flow (Q of FIG. 4(2)) ceases, maybe to be replaced with an opposite (anti-Q) flow. With no hydrodynamic pressure to resist it (and possibly with hydrodynamic pressure to assist it), the spring (J) causes the fin (G) to pivot back into the stowed position. Also unopposed (and possibly aided) by hydrodynamic pressure, the spring (K of FIG. 3) moves the fin (G) forward along the axle (N). Once in the stowed position, the stowed-position holder engages once again. Because the fin (G) has been moved to the stowed position by spring (J), the notch (H2 of FIG. 3) in the fin (G) no longer aligns with the protrusion (H1), and that protrusion (H1) again prevents the fin (G) from pivoting outwards to the deployed position.

Figure 5:
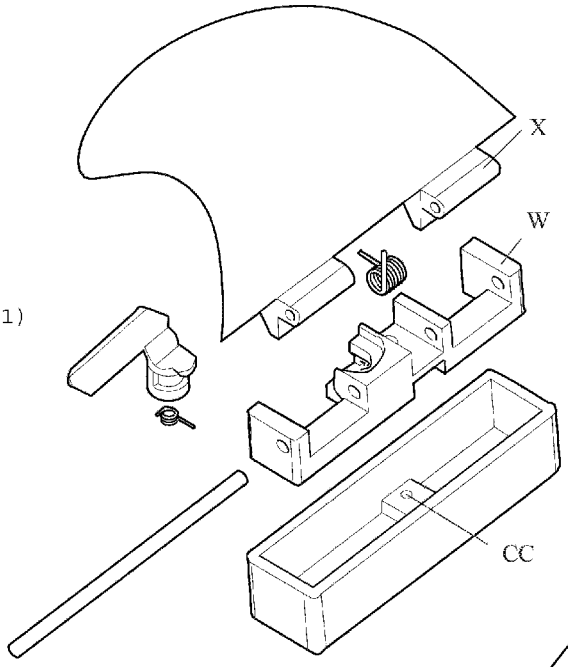
FIG. 5 (two views) presents an example fin-assembly embodiment where most of the mechanism is below the surface of (i.e., within the body of) the watercraft. The fin (U) pivots (hinges X and axle Y) on a fin base (W) which mounts into a secondary base (BB) which in turns mounts into a correspondingly-shaped hole (not shown) in the body of the watercraft. This embodiment uses a rotating lever (V1, V2, V3, springs Z and AA) as the stowed-position holder and also has surfaces (EE) to prevent over-extension of the fin (U).
Figure 5:
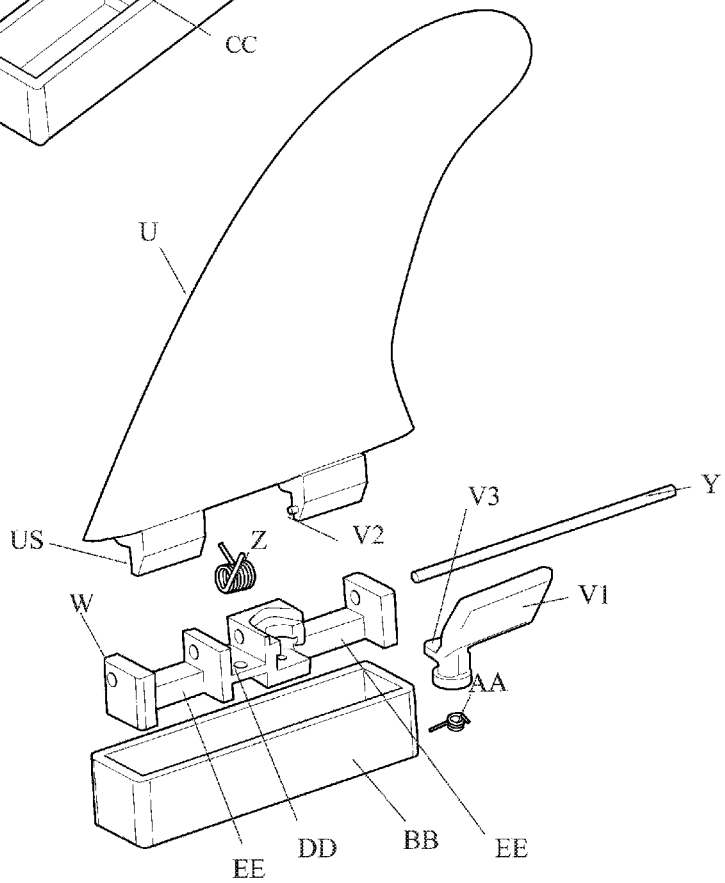
Figure 6:
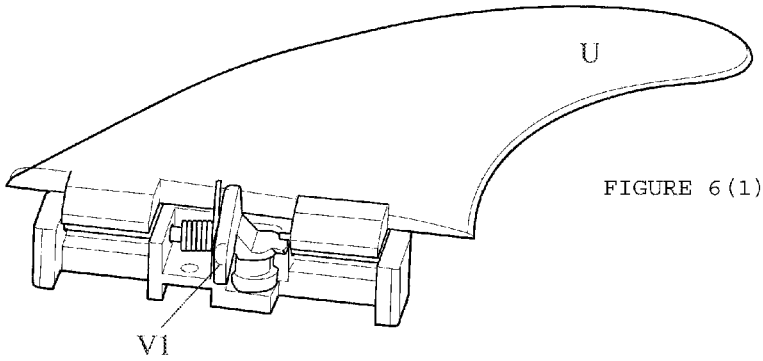
FIG. 6 shows the example fin (U) of FIG. 5 deploying.
Figure 6:
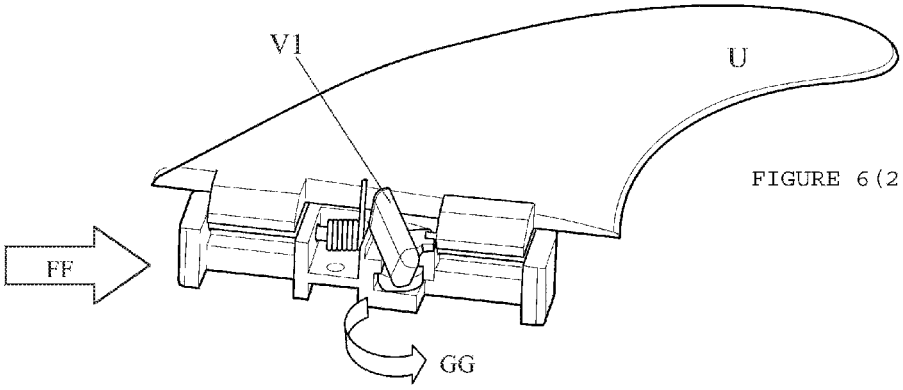
Figure 6:
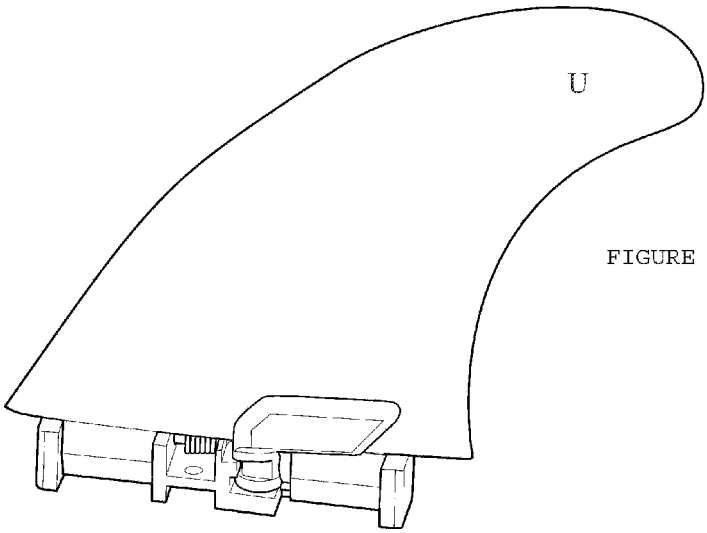

For a second example embodiment, FIGS. 5 and 6 may be considered together. FIG. 5 shows the parts of this embodiment from both sides, and FIG. 6 shows the fin deploying. In this embodiment, hinges (X) on the fin (U) pivot on an axle (Y) set into the fin base (W). The fin base (W) in turn sits in a secondary base (BB) which mounts to the watercraft itself (not shown). The fin base (W), the secondary base (BB), and the watercraft can be held together by screws in holes (CC, DD), by epoxy, or by other known methods. A spring (Z) biases the fin (U) toward the stowed position.

This embodiment also includes a stowed-position holder. A rotating lever (V1) includes a shoulder (V3) that can interfere with a tab (V2) on the fin (U). FIG. 6(1) shows the stowed-position holder engaged: The fin (U) has been pivoted to the stowed position by the spring (Z). The rotating lever (V1) is turned to the "hold" position (that of FIG. 6(1)) by a spring (AA of FIG. 5). While in the hold position, the shoulder (V3) of the lever (V1) interferes with the tab (V2) of the fin (U) and prevents the fin (U) from pivoting out to the deployed position.

When it comes time to deploy the fin (U), the water is flowing (FF) in the direction as seen in FIG. 6(2). The force of this flow (FF) pushes against the broad side of the lever (V1) causing it to rotate (GG) against the spring (AA). When the lever (V1) rotates far enough, its shoulder (V3) no longer interferes with the tab (V2) on the fin (U). With the stowed-position holder disengaged, the fin (U) is free to pivot to the deployed position. As discussed above, hydrodynamic forces caused by the flow (FF) force the fin (U) to pivot against the spring (Z) until the fin (U) reaches the deployed position (FIG. 6(3)). Similar to the above embodiments, a shoulder (US) of the fin (U) engages a corresponding abutment EE of the fin base (W) to prevent over-extension.

Moving the fin (U) from the deployed to the stowed position will now be described. When the water flow reverses (to anti-FF) or simply stops, the hydrodynamic forces keeping the fin (U) in the deployed position diminish or vanish entirely. The spring (Z) is free to pivot the fin (U) back to the stowed position. Once there, the spring (AA) rotates the lever (V1) back to its hold position where its shoulder (V3) again interferes with the tab (V2) on the fin (U) and holds the fin (U) in place.

Figure 7:
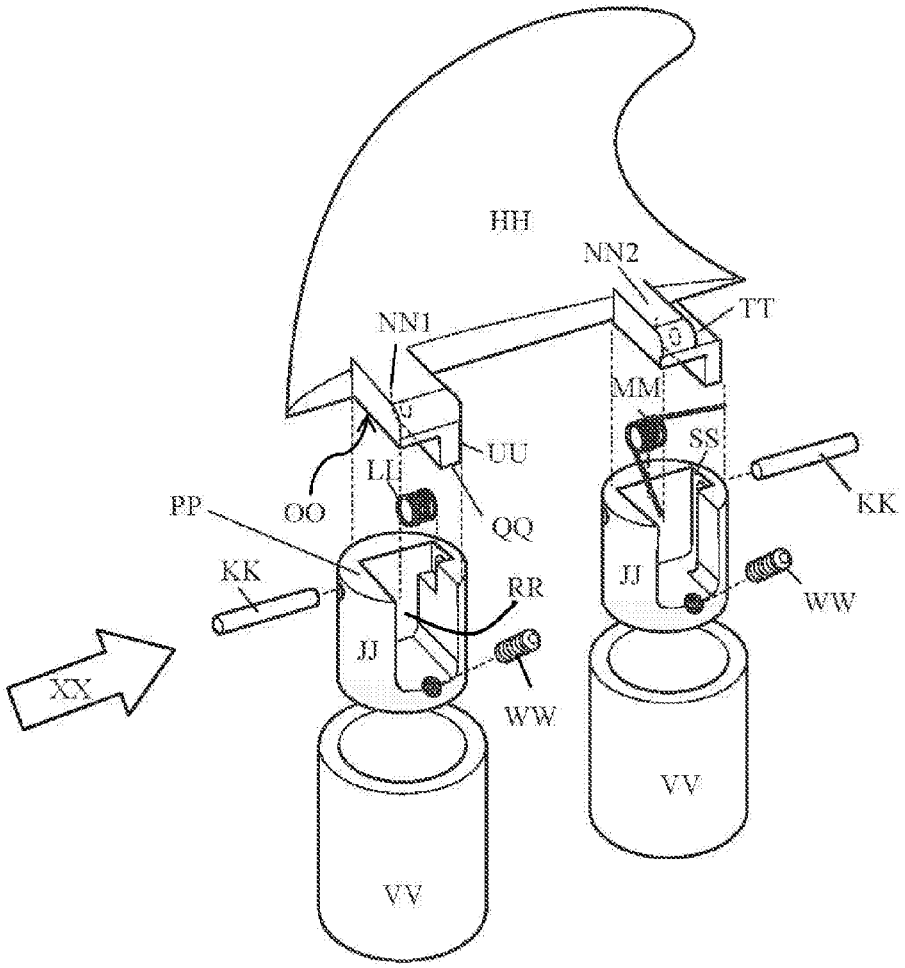
FIG. 7 presents yet another example embodiment of a fin assembly. The fin (HH) pivots (axles KK) on fin-base plugs (JJ) which are secured into secondary bases (VV) by set screws (WW). When Fin HH is in the stowed position, fin tabs NN1 and NN2 slide (translate longitudinally) on axles KK to a forward position (opposite direction XX) under force from spring LL. This causes surface OO of fin tab NN1 to move over the top of and mechanically interfere with the horizontal surface PP of fin plug JJ, thus preventing fin HH from rotating about axles KK and deploying. When water moves sufficiently from the fore to aft direction (direction XX) over the fin HH, the force of the moving water overcomes the forward-pushing force of spring LL and fin HH slides rearwards (in direction XX), thereby disengaging surface OO from horizontal surface PP of fin plug JJ, allowing the fin HH to rotate about axles KK to the deployed position (e.g., position B in FIG. 1). In the deployed position surface QQ of fin tab NN1 engages against surface RR, preventing overextension.

For a third illustrative example embodiment, consider FIG. 7. This embodiment uses a two-piece base. The fin (HH) pivots on two axles (KK) which are set into the two base plugs (JJ). The base plugs (JJ) are fixed to the bases (VV) using set screws (WW). A spring (MM) biases the fin (HH) toward the stowed position. The fin (HH) can also move longitudinally along the axis of the axles (KK). This movement is part of the stowed-position holder. Surrounding one of the axles (KK) is a spring (LL) which presses against the face (UU) of a tab (NN1) of the fin (HH) and also against an inner face of the base plug (JJ). When in the stowed position, the pressure of the spring (LL) pushes the face (OO) of the tab (NN1) against another inner face (PP) of the base plug (JJ). When Fin HH is in the stowed position, fin tabs NN1 and NN2 slide (translate longitudinally) on axles KK to a forward position (opposite direction XX) under force from spring LL. This causes surface OO of fin tab NN1 to move over the top of and mechanically interfere with the horizontal surface PP of fin plug JJ, thus preventing fin HH from rotating about axles KK and deploying. When water moves sufficiently from the fore to aft direction (direction XX) over the fin HH, the force of the moving water overcomes the forward-pushing force of spring LL and fin HH slides rearwards (in direction XX), thereby disengaging surface OO from horizontal surface PP of fin plug JJ, allowing the fin HH to rotate about axles KK to the deployed position (e.g., position B in FIG. 1) when pressure from the water flow (XX) pushes against the fin (HH). The hydrodynamic force working on the fin (HH) then causes the fin (HH) to pivot to the deployed position. When in the deployed position, faces (QQ) on the tabs (NN1, NN2) of the fin (HH) press against inner faces (RR) of the base plugs (JJ) to prevent over-extension.

This embodiment also includes a deployed-position holder. When in the deployed position, the fin (HH) is pressed slightly backwards by the force of the water flow (XX). At least one of the tabs (NN2) of the fin (HH) slides rearward into a slot (SS) in the base plug (JJ). As long as the fin (HH) is in the deployed position, the slot (SS) holds the tab (NN2) in place preventing the fin (HH) from pivoting back to the stowed position.

When the pressure of the water flow (XX) reverses or vanishes, the spring (LL) pushes the fin (HH) forward again which removes the tab (NN2) from the deployment-position holder slot (SS). The fin (HH) is then free to pivot back to the stowed position under the impetus of the spring (MM). Once in the stowed position, the spring (LL) again pushes the face (OO) of the tab (NN1) against the inner face (PP) of the base plug (JJ), thus keeping the fin (HH) in the stowed position by mechanical interference.

While the above three embodiments show some of the scope of possible implementations, they do not cover the entire range. For example, the deployment-position holder of FIG. 7 can be applied to the embodiment of FIGS. 3 and 4 with some modification. Some embodiments may not use either the stowed-position holder or the deployed-position holder or may use well known engineering principles to vary the illustrated holders. Even the springs biasing the fins to the stowed position may be left out. In some embodiments, the parts count can be lowered by configuring one spring to work in more than one direction or for more than one function. As discussed above, the number and arrangement of fin assemblies on a given watercraft can vary and can include a pivoting fin assembly located on the longitudinal centerline of the watercraft. The assemblies may be mounted to the watercraft using screws or glues, or they may be snapped into place.

The materials should be suitable for use in fresh or salt water. The components, while strong, may also be light to allow aerial maneuvers. High-stress components, such as the hinges and springs, can be made of corrosion-resistant metals or even ceramic. Other components can be formed from lightweight plastics or resin.

Any of the suitable technologies and materials set forth and incorporated herein may be used to implement various example aspects of the invention as would be apparent to one of skill in the art. In view of the many possible embodiments to which the principles of the present discussion may be applied, it should be recognized that the embodiments described herein with respect to the drawing figures are meant to be illustrative only and should not be taken as limiting the scope of the claims. Therefore, the techniques as described herein contemplate all such embodiments as may come within the scope of the following claims and equivalents thereof.

What is claimed is:

1. A fin assembly comprising:

a fin base comprising a watercraft mount configured to mount the fin assembly to a substantially planar surface of an exterior of a watercraft;

a fin comprising a body extending in a first longitudinal direction from a front portion to a rear portion and extending in a second longitudinal direction from a base portion to a tip portion;

a coupling configured to pivotably attach the base portion of the fin to the fin base so that when the fin assembly is mounted to the substantially planar surface of the exterior of the watercraft, the fin body may pivot about an axis that is at least substantially parallel with the first longitudinal direction to allow the fin body to pivot between a deployed position wherein the second longitudinal direction is substantially perpendicular to the planar surface of the exterior of the watercraft, and a stowed position wherein the second longitudinal direction is substantially parallel to the planar surface of the exterior of the watercraft;

a biasing element configured to bias the fin toward the stowed position; and a stowed-position holder configured to tend to hold the fin in the stowed position, the stowed-position holder comprising a mechanical interference between the fin and the fin base when the fin is in the stowed position.

2. The fin assembly of claim 1, wherein the coupling comprises an element selected from the group consisting of: a hinge; an elastomeric element.

3. The fin assembly of claim 1, further comprising a deployed-position holder configured to tend to hold the fin in the deployed position.

4. The fin assembly of claim 3, wherein the deployed-position holder comprises a slot in the coupling that engages the fin when the fin is in the deployed position.

5. The fin assembly of claim 1, wherein the fin is configured to be longitudinally translated from a first longitudinal position to a second longitudinal position, and the mechanical interference comprises a portion of the fin that mechanically interferes with another portion of the fin assembly when the fin is in the first longitudinal position and does not mechanically interfere with said another portion of the fin assembly when the fin is in the second longitudinal position.

6. The fin assembly of claim 5, wherein the fin is configured to be longitudinally translated from the first longitudinal position to the second longitudinal position by the force of water traveling over the fin.

7. A fin assembly comprising:

a fin base comprising a watercraft mount configured to mount the fin assembly to a substantially planar surface of an exterior of a watercraft;

a fin comprising a body extending in a first longitudinal direction from a front portion to a rear portion and extending in a second longitudinal direction from a base portion to a tip portion;

a coupling configured to pivotably attach the base portion of the fin to the fin base so that when the fin assembly is mounted to the substantially planar surface of the exterior of the watercraft, the fin body may pivot about an axis that is at least substantially parallel with the first longitudinal direction to allow the fin body to pivot between a deployed position wherein the second longitudinal direction is substantially perpendicular to the planar surface of the exterior of the watercraft, and a stowed position wherein the second longitudinal direction is substantially parallel to the planar surface of the exterior of the watercraft;

a biasing element configured to bias the fin toward the stowed position;

a stowed-position holder configured to tend to hold the fin in the stowed position, the stowed-position holder comprising an interference element configured to tend to prevent the fin from pivoting toward the deployed position when the fin is in the stowed position;

wherein the interference element comprises a lever rotatable between at least two positions.

8. A watercraft comprising:

a body extending longitudinally from a first end to a second end, the body comprising an undersurface;

at least one fin assembly of claim 1 disposed proximate one of the first end and the second end, wherein the fin of the at least one fin assembly is pivotably coupled with the undersurface, each fin being pivotable between the deployed position wherein the fin extends substantially perpendicularly to the undersurface, and the stowed position wherein each fin extends substantially parallel to the undersurface;

wherein the at least one fin assembly is configured so that when water flows past the respective fin in a chordwise direction from an end of the body distal the fin toward an end of the body proximate the fin, hydrodynamic force biases the fin toward the deployed position; and wherein the biasing element of the at least one fin assembly biases the respective fin toward the stowed position so that the fin tends to return to the stowed position when no water flows past the fin.

9. The watercraft of claim 8, wherein the watercraft is selected from the group consisting of: a surfboard, a paddleboard, a kayak, and a wakesurf board.

10. The watercraft of claim 8, wherein the at least one fin assembly further comprises two fin assemblies proximate the first end of the body and two fin assemblies proximate the second end of the body, the fin assemblies mounted to the body symmetrically about a longitudinal centerline of the body;

wherein the fins on a first side of the longitudinal centerline pivot in a first direction, and the fins on a second side of the longitudinal centerline pivot in a second direction opposite the first direction.

11. The watercraft of claim 8, wherein the at least one fin assembly further comprises two fin assemblies proximate the first end of the body and two fin assemblies of proximate the second end of the body, the fin assemblies mounted to the body asymmetrically about a longitudinal centerline of the body;

wherein the fins on a first side of the longitudinal centerline pivot in a first direction, and the fins on a second side of the longitudinal centerline pivot in a second direction opposite the first direction.

12. The watercraft of claim 8, wherein the stowed-position holder of the at least one fin assembly is configured to tend to hold the respective fin in the stowed position and then to release the respective fin to pivot toward the deployed position when water flows past the fin with a sufficient force in a chordwise direction from an end of the body distal the fin toward an end of the body proximate the fin.

13. The watercraft of claim 8, wherein the at least one fin assembly comprises a deployed-position holder, the deployed-position holder being configured to tend to hold the respective fin in the deployed position as long as water flows past the fin with a sufficient force in a chordwise direction from an end of the body distal the fin toward an end of the body proximate the fin.

14. A method of incorporating the fin assembly of claim 1 on a substantially planar surface of an exterior of a watercraft, comprising the steps of:

providing a watercraft having a substantially planar surface on an exterior of the watercraft;

providing at least one fin assembly of claim 1; and mounting the at least one fin assembly to the substantially planar surface of the exterior of the watercraft.

15. The method of claim 14, further comprising the steps of:

providing the at least one fin assembly with at least two fin assemblies; and mounting each of the fin assemblies to the substantially planar surface of the exterior of the watercraft symmetrically about a longitudinal centerline of the watercraft so that the fin on a first side of the longitudinal centerline pivots in a first direction, and the fin on a second side of the longitudinal centerline pivots in a second direction opposite the first direction.

16. The method of claim 14, further comprising the steps of:

providing the at least one fin assembly with a plurality of fin assemblies;

mounting at least a first two of the fin assemblies to the substantially planar surface of the exterior of the watercraft symmetrically about a longitudinal centerline of the watercraft and proximate a first end of the watercraft;

mounting at least a second two of the fin assemblies to the substantially planar surface of the exterior of the watercraft symmetrically about a longitudinal centerline of the watercraft and proximate a second end of the watercraft opposite the first end of the watercraft; and said mounting steps positioning the fin assemblies so that the fins on a first side of the longitudinal centerline pivot in a first direction, and the fins on a second side of the longitudinal centerline pivot in a second direction opposite the first direction.

17. The method of claim 16, further comprising the steps of:

mounting the first two and the second two of the fin assemblies to the substantially planar surface of the exterior of the watercraft symmetrically about a line perpendicular to the centerline of the watercraft, so that:

water flowing over the fins in a first direction parallel to the centerline of the watercraft urges the respective fins of the first two of the fin assemblies to pivot toward the deployed position; and water flowing over the fins in a second direction parallel to the centerline of the watercraft and opposite the first direction urges the respective fins of the second two of the fin assemblies to pivot toward the deployed position.

18. The method of claim 17, further comprising the steps of:

riding the watercraft so that water flows over the fins in the first direction and causing one or more of the fins of the first two fin assemblies to pivot to the deployed position;

riding the watercraft so that water stops flowing over the fins of the first two fin assemblies and causing the fins of the first two fin assemblies to pivot to the stowed position; and riding the watercraft so that water flows over the fins of the second two fin assemblies in the second direction and causing one or more the fins of the second two fin assemblies to pivot to the deployed position.

* * * * *